US008025146B2

(12) United States Patent
Willis et al.

(10) Patent No.: US 8,025,146 B2
(45) Date of Patent: Sep. 27, 2011

(54) COOLEEBOB COMPLIANT UPRIGHT DRINK INSULATOR ATTACHMENT

(76) Inventors: Lee P. Willis, Huntington Beach, CA (US); Marilyn Elaine Willis, Huntington Beach, CA (US); Cory Lee Willis, Huntington Beach, CA (US); Trevor Willis, Huntington Beach, CA (US); Spencer Tyler Willis, Huntington Beach, CA (US)

( * ) Notice: Subject to any disclaimer, the term of this patent is extended or adjusted under 35 U.S.C. 154(b) by 288 days.

(21) Appl. No.: 12/472,694

(22) Filed: May 27, 2009

(65) Prior Publication Data

US 2010/0301053 A1 Dec. 2, 2010

(51) Int. Cl.
*B65D 77/00* (2006.01)

(52) U.S. Cl. ..... 206/217; 40/324; 40/658; 40/666

(58) Field of Classification Search ..... 220/903, 220/375, 739, 592.16, 592.17, 603, 737, 220/738; 224/254; 441/136; 206/217, 38, 206/37, 37.1; 40/310, 330, 634, 661.11, 40/324, 658, 666
See application file for complete search history.

(56) References Cited

U.S. PATENT DOCUMENTS

| | | | | |
|---|---|---|---|---|
| 4,190,975 | A * | 3/1980 | Murphy | 40/634 |
| 4,443,203 | A | 4/1984 | Maertens | |
| 4,571,194 | A | 2/1986 | Kiss | |
| 4,671,424 | A | 6/1987 | Byrns | |
| 4,927,041 | A | 5/1990 | Hepburn | |
| 5,088,948 | A | 2/1992 | Scheurer | |
| 5,447,764 | A | 9/1995 | Langford | |
| 5,727,709 | A | 3/1998 | Nobile | |
| 5,762,234 | A * | 6/1998 | Kiel et al. | 220/737 |
| 6,029,845 | A | 2/2000 | Mueller | |
| D440,469 | S | 4/2001 | Krist | |
| 6,491,179 | B2 | 12/2002 | Dokun | |
| 6,607,090 | B1 | 8/2003 | Doerr | |
| 6,616,493 | B2 | 9/2003 | Powell | |
| 6,991,505 | B1 * | 1/2006 | Wells | 441/136 |
| 7,690,142 | B2 * | 4/2010 | Pollack | 40/658 |
| D629,464 | S * | 12/2010 | Brodsky et al. | D20/25 |
| 2003/0077958 | A1 | 4/2003 | Powell | |
| 2004/0006900 | A1 * | 1/2004 | Beller | 40/329 |
| 2008/0078788 | A1 | 4/2008 | Degges | |

* cited by examiner

*Primary Examiner* — J. Gregory Pickett
*Assistant Examiner* — Raven Collins
(74) *Attorney, Agent, or Firm* — Kirk A. Buhler; Buhler & Associates

(57) ABSTRACT

Improvements in a compliant upright drink insulator attachment device that is works with a standard drink insulator. The attachment device uses two parts where one part mates with the second part to slip through a standard insulated drink holder. These insulated drink holders are commonly called coolies or koozies and are manufactured with a central hole to allow for draining. A clip connects a compliant cord to one or both of the two parts. The compliant cord is configured as a coiled cord. A weight is connected to the free end of the compliant cord to keep the insulated drink holder in an upright orientation in the water. The compliant cord allows the weight to move semi independent from the insulated drink holder, and further allows the weight to be stored within the insulated drink holder for storage when it is not being used.

20 Claims, 4 Drawing Sheets

COOLEEBOB COMPLIANT UPRIGHT DRINK INSULATOR ATTACHMENT

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in a beverage flotation device. More particularly the improvement relates to an attachment for a beverage cooler that retains the beverage in an upright orientation.

2. Description of Related Art Including Information Disclosed Under 37 CFR 1.97 and 1.98

Several products and patents have been filed an issued on drink insulators and retaining devices for beverages that are consumed while a person is in the water. Depending upon the amount of wakes that are encountered while on the water and the amount of natural or artificial topography that exists in the body of water the beverage can tip over. Some of these devices operate as stand-alone flotation devices or utilize existing beverage coolers coolies or koozies. Exemplary examples of patents covering these products are disclosed herein.

U.S. Pat. No. 4,571,194 issued Feb. 18, 1986 to James M. Kiss et al., and U.S. Pat. No. 6,607,090 issued Aug. 19, 2003 to Stephen Doerr disclose floating beverage holders that a user blows air into the inflate the float. The user can then open to filling valve to deflate the float when it is not being used. While this patent provides for a floatation device the amount of thermal insulation to the beverage is limited. The physical size of these devices is also significant because the floatation area must be significantly large to create enough width to make the float stable in the water.

U.S. Pat. No. D440,469 issued Apr. 17, 2001 to John J. Krist et al discloses a Floatation Holder For a Beverage Container. This design patent is a for a molded or formed beverage holder with an enlarged base that provides for a floatation device. This device requires a wide base for floatation. When a full soda container is placed within the container it is top heavy and can tip over with a large wave.

U.S. Pat. No. 5,447,764 issued Sep. 5, 1995 to Mark H. Langford and U.S. Pat. No. 6,616,493 issued Sep. 9, 2003 both disclose an essentially thick flat foam float that slides around the cylindrical side of the soda can. This is a simple version of a floatation device, but it provides minimal insulation to the beverage can and the location of the floatation device on the soda can is variable based upon placement by the user. If the floatation device is not placed properly on the can the can is more susceptible to tipping over.

U.S. Pat. No. 6,991,505 issued Jan. 31, 2006 to Robert Ray Wells discloses a Buoyant Apparatus for Attachment to Beverage Insulators Holding Beverage Containers. The device works with a standard beverage container insulator. The bottom of the beverage container insulator must be modified to allow the attachment to fit through the bottom of the insulator. The bottom of the buoyant apparatus is rigid and can tip over if the weighted end comes in contact with a rock or the ground.

What is needed is a compliant upright drink insulator attachment that works with an existing drink insulator. The bottom of the attachment device needs to be compliant to move with the waves of the water and compliant enough to still keep the drink in an upright orientation around rocks and shallow water.

BRIEF SUMMARY OF THE INVENTION

It is an object of the compliant upright drink insulator attachment device that starts as a two parts where one part mates with the second part to slip through a standard insulated drink holder. These insulated drink holders are commonly called coolies or koozies and are manufactured with a central hole to allow for draining. The two part clip mate through the drainage hole in an open configuration to allow for both draining and to prevent the insulator from sealing onto the beverage can where removal would require overcoming the vacuum of the seal.

It is another object of the compliant upright drink insulator attachment device to have a pass though hole or holes to allow connection of a clip with a cord. The hole or holes allow a user to connect the cord on a variety of sides or orientations. A standard clipping device is used to connect to the hole(s) by passing an open clip through two opposing holes.

It is another object of the compliant upright drink insulator attachment device to utilize a compliant cord. The compliant cord is preferably coiled to allow the cord to bend when the cord comes in contact with rocks or the ground in shallow water. At the end of the cord is a weight that provides a pendulum and ballast to keep a can installed in the insulator in an upright orientation.

It is still another object of the compliant upright drink insulator attachment device to utilize a buoyant weight that can customizable to match the owner's name, sporting team, zodiac sign, company, color or a simple number of letter. When not used the weight can be stored in the empty insulator to reduce storage space and make transportation easier.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
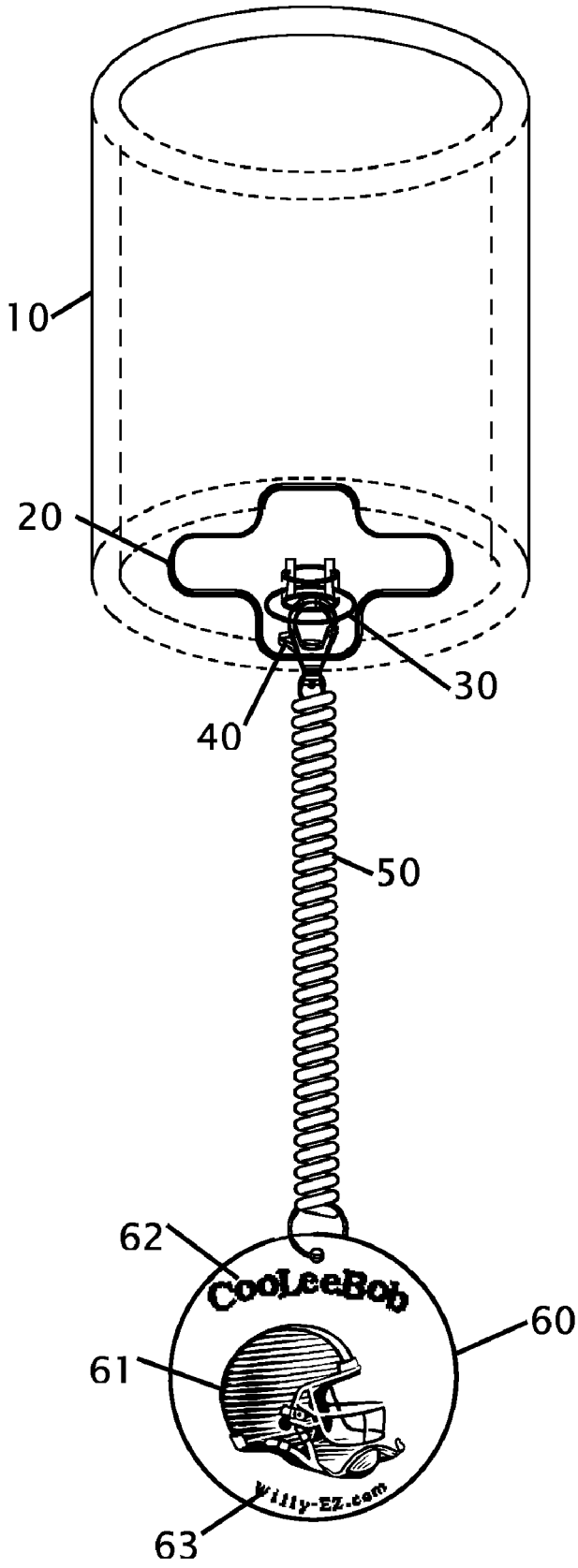
FIG. 1 shows an overall perspective view of the drink insulator attachment.

FIG. 1 shows an overall perspective view of the drink insulator 10 attachment. The insulated drink holder 10 is known as coolies or koozies. The attachment device connects through a central hole in the bottom of the insulated drink holder 10. The attachment device has an inner collar or first member 20, and an outer snap button or second member 30. A clip 40 connects through the first 20 and or second 30 members. The clip 40 has a swivel that reduces knotting or kinking and further allows for free rotation of the tether, lanyard or plastic coiled cord 50. The lanyard 50 can be made out of numerous materials such as plastic, rubber, fabric material or a light rod of types. The Lanyard needs to be able to hang down below the koozie cup, swing freely in any vertical direction. A weight 60 is connected to the other end of the lanyard 50.

The weight 60 creates a pendulum. The pendulum weight 60 can be any color, made out of any material and can have any type of indicia 61 shape or design on it for decoration. The indicia can be a company logo, slogan, sport logo, football helmet, baseball, soccer ball, basketball zodiac sign, hobby or animal(s). The indicia can also include a logo 62 and or a website 63 for advertising. In the preferred embodiment the pendulum weight 60 is shaped like a disk, but other shapes such as square, spherical, triangular, diamond and others are contemplated. The disk or a sphere is preferred because there is less potential for injury is a person steps onto the pendulum weight 60. When not used the weight can be stored in the empty insulator to reduce storage space and make transportation easier.

The pendulum weight 60 is at the end of the Lanyard and is keeping constant pressure on the container in order to keep the beverage afloat. Lifting up on the Pendulum Weight could possibly tip the beverage over.

The Pendulum Weight is between 5.0 ounces and 5.5 ounces.

How it Works

The manner of how the CooLeeBob works is the basic principles of a Conical Pendulum. The CooLeeBob consists of a Weight suspended from a cord, spring coil or a light rod and made to rotate in a horizontal circle about a vertical axis with a constant angular velocity of N r/min. For any given constant speed of rotation, the angle θ, the radius r, and the height h, will have fixed values.

The figure below shows that the forces in the vertical direction must be balanced, T cos θ=w. The forces in the direction normal to the circular path if rotation are unbalanced such that T sin θ=(w/g) a/n=(w/g) w\2r. Substituting r=1 sin θ in the last equation the value of the tension in the cord T=(w/g) Iw\2.

Dividing the second equation by the first and substituting the tan θ=r/h yield the additional relation the h=g/w\2.

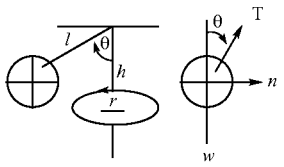

The exact Weight depends on the amount of the beverage (ounces) left inside the container and the thickness of the foam koozie itself. Mathematically; after every sip of the beverage from the container the Weight distribution changes but the constant is still there. Testing has shown that the pendulum weight 60 should be between 2 and 8 ounces and more preferably between 5.0 and 5.5 ounces.

Figure 2:
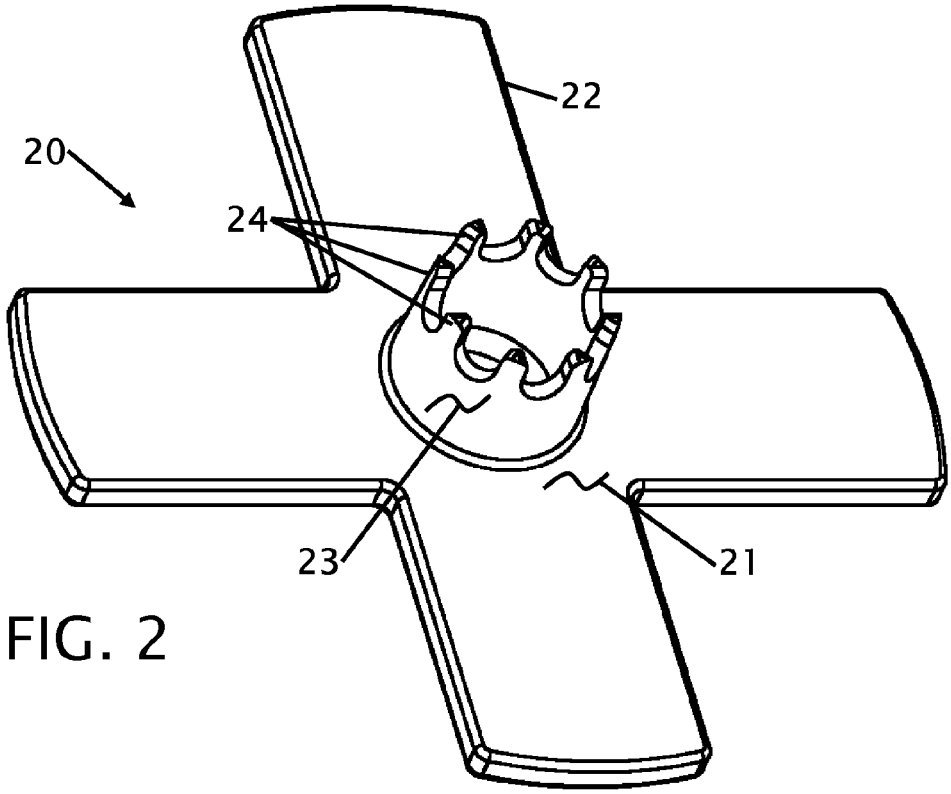
FIG. 2 shows a perspective view of the inner collar or first member.
Figure 3:
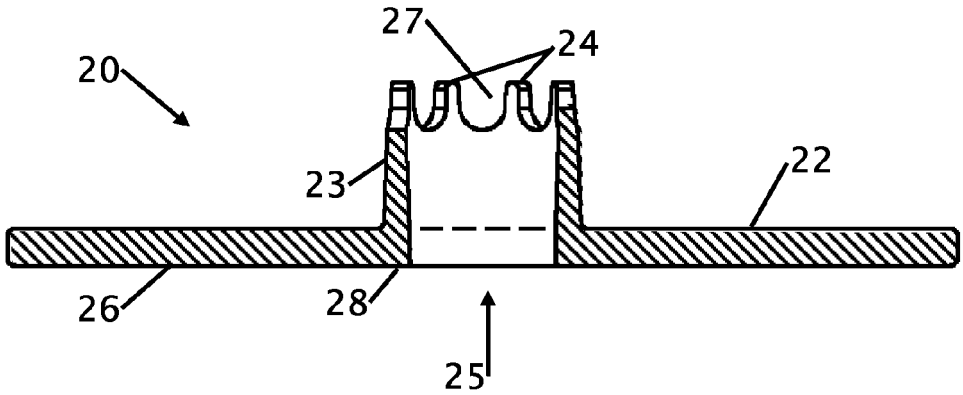
FIG. 3 shows a sectional view of the inner collar.

FIG. 2 shows a perspective view of the inner collar or first member. FIG. 3 shows a sectional view of the inner collar. Inner collar or first member 20. The inner collar 20 consists of a piece you insert into the koozie cup (not shown) and press down into the hole in the bottom of the holder. The size of the inner collar 20 can be various sizes but needs to be larger than the relief hole at the bottom of the koozie cup but not larger than the inner diameter of the cup. The inner collar 20 should have an access hole 25 to allow air and drainage to get into the bottom of the koozie to help release the beverage container.

The inner collar 20 has a central hole 25 with a plurality of extensions 22 that extend from said central hole 25 in an essentially planar arrangement that is perpendicular to the central hole 25. In the preferred embodiment there are four extensions 22, but it is contemplated that as few as two or three to more than four extensions 22 can be used. The inner collar 20 further has a vertical circular wall 23 with a crown top 24 that extends concentric around the central hole 25 and is configured to fit through the bottom hole of a beverage insulator. The inner collar 20 is preferably made from plastic but it is also contemplated that the inner collar 20 can be made from steel, stainless steel, rubber, plastic, carbon fiber, acrylic, wood or fiberglass. It is further contemplated that the inner collar 20 can also come in any color or a mixture of colors. The inner collar 20 is preferably flexible to allow the upper surface 26 of the inner collar 20 to be used to assist in pushing an installed beverage can out of the insulated beverage holder. The bottom surface 21 of the inner collar 20 rests against the inside bottom of the insulated beverage holder when properly installed. The crown of the inner collar 20 has a series of voids 27 where the clip (Item 40 from FIG. 1) connects through the inner collar 20. The outer edge 28 of the inner collar 20 allows for engagement with tabs 36 of the outer snap button 30 shown in FIG. 4.

Figure 4:
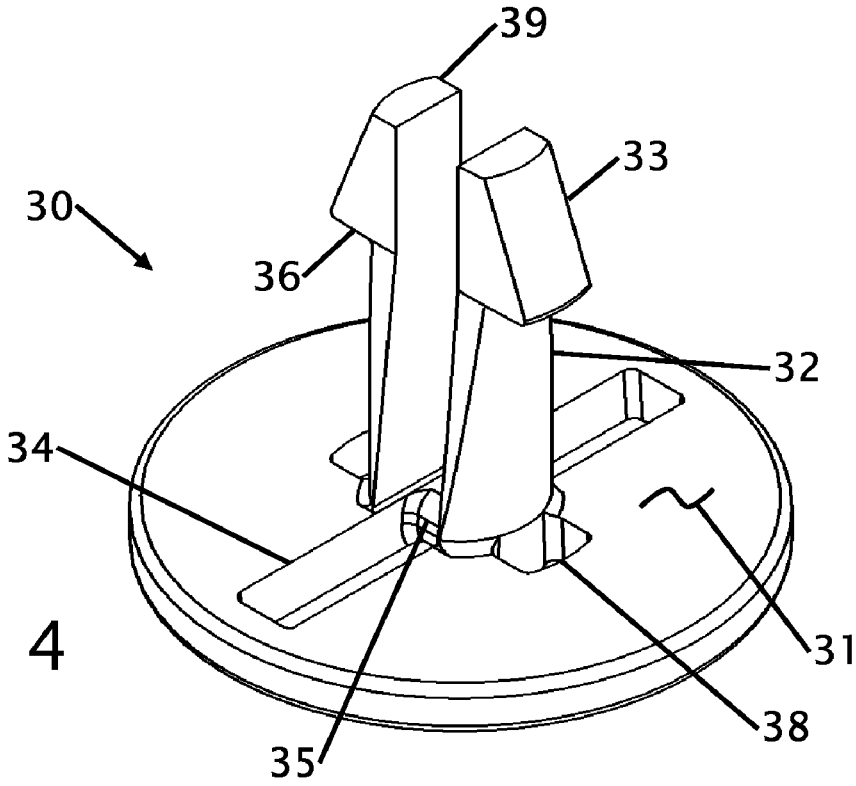
FIG. 4 shows a second preferred embodiment of a perspective view of the outer snap button or second member.
Figure 5:
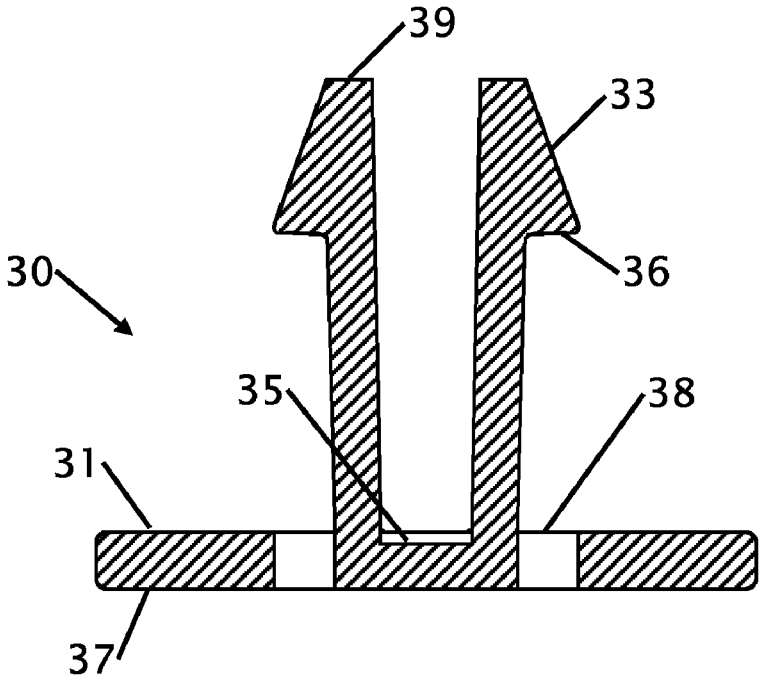
FIG. 5 shows a sectional view of the outer snap button.

FIG. 4 shows a second preferred embodiment of a perspective view of the outer snap button 30 or second member. FIG. 5 shows a sectional view of the outer snap button 30. The outer snap button 30 presses up to the inner collar 20 until it snaps on. It is also contemplated that the outer snap button 30 could also screw into the inner collar 20. The outer snap button 20 should stay relatively small, but should be large enough not to slip into the relief hole of the koozie and to clip the lanyard on it. The outer snap button should have an access hole to allow air to get into the bottom of the koozie to help release the beverage container while attached to the Inner collar.

The outer snap button 30 has an essentially planar base with an upper surface 31 with a plurality of elongated finger 32 with tabs 36 located along the elongated finger 32. The tabs 36 are configured to engage into the central hole 25 (In FIG. 3) in the inner collar 20. The plurality of elongated fingers 32 are also configured for placement through a bottom hole of an insulated drink holder 14 (shown in FIGS. 6 and 7). The elongated fingers 32 have a snap ramp 33 and a head 39 on top of each finger to guide the fingers 32 into the central hole of the inner collar. A hook slot 34 allows a clip to pass between the fingers 32 for securing the snap onto a hook boss or land 35. The lower surface 37 of the outer snap button 30 exists on the outside of the assembly. A void 38 exists on the outer snap button to provide a shut-off opening to form the snap tabs 36.

The outer snap button 30 can be made from steel, stainless steel, rubber, plastic, carbon fiber, acrylic, wood or fiberglass. It is further contemplated that the inner collar 20 can also come in any color or a mixture of colors.

Figure 6:
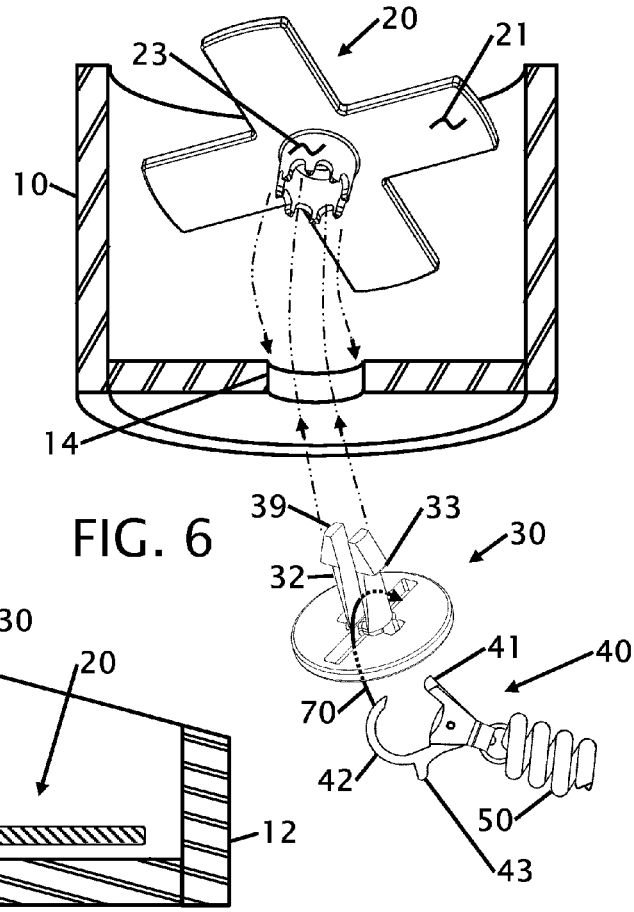
FIG. 6 shows a perspective exploded assembly view of the drink insulator attachment with an insulated drink holder.

FIG. 6 shows a perspective exploded assembly view of the drink insulator attachment with an insulated drink holder 10. The insulated drink holder 10 has a bottom hole 14 through which the attachment device is secured. The inner collar 20 is brought down so the sides of the perpendicular central hole extension 23 extends into and through the relief hole 14. When the inner collar 20 is placed within the central hole 14, the lower surface 21 of the plurality of extension arms are in contact with the bottom of the insulated drink holder 10. The outer snap button 30 is moved into the inner collar such that the top of the snap 39 is placed through the central hole of the inner collar 20. When the snap button 30 is further pressed into the inner collar 20, the elongated fingers 32 will bend and then open to engaged the snap ramp 33 and the bottom of the snaps onto the outside of the inner collar 20. The clip finger 42 of the clip 40 is opened with the clip lever 43 and connected 70 through the outer snap button 30 and through the crown of the inner collar 30, where it is closed on the clip tongue 41 to secure the plastic coiled cord 50.

Figure 7:
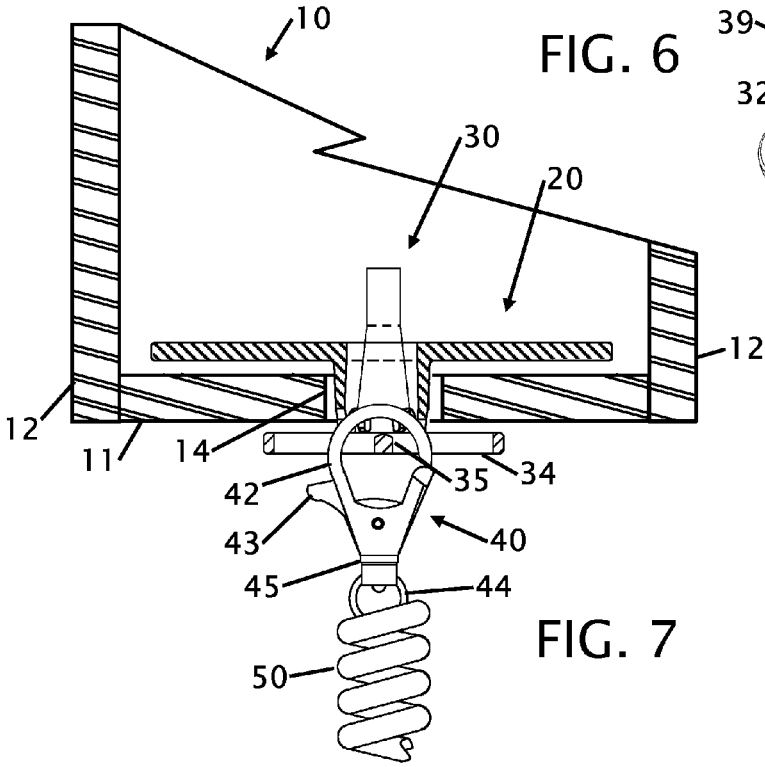
FIG. 7 shows a sectional view of the drink insulator attachment secured to an insulated drink holder.

FIG. 7 shows a sectional view of the drink insulator attachment secured to an insulated drink holder 10. The insulated drink holder 10 is typically formed with two parts having an outer cylindrical body 12 that is bonded to a circular base 11 with a relied hole 14. The inner collar 20 is shown secured to the snap button 30 with the clip finger 42 of the clip 40 secured through the snap button 30 and around the hook boss or land 35. The clip lever 43 can be depressed to install or remove the clip 40 from the assembly of the inner collar 20 and the outer snap button 30. A ring 44 connects the clip 40 to the plastic coiled cord through a swivel 45 connection that allows the clip to turn independently from the plastic coiled cord 50.

The attachment device is removable from said beverage insulator by squeezing the elongated fingers 32 of the outer snap button 30 and pressing the outer snap button 30 through the central hole of both the inner collar and the relief hole 14 of the insulated drunk holder 10.

Thus, specific embodiments of a CooLeeBob compliant upright drink insulator attachment device have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A compliant upright drink insulator attachment device comprising:

a first member having a central hole with a plurality of extensions that extends from said central hole in an essentially planar arrangement that is perpendicular to the central hole;

said first member further has a crown that extends concentric with said central hole and is configured to fit through the bottom hole of a beverage insulator;

a second member having an essentially planar base with a plurality of elongated finger with tabs located along the elongated finger;

said tabs are configured to engage into said central hole in said first member;

said plurality of elongated fingers is placed through a bottom hole of an insulated drink holder;

a tether configured for securing a first end onto said first and or said second member, and said tether having a second end configured for securing to a weight.

2. The compliant upright drink insulator attachment device according to claim 1 wherein said central hole in said first member provides for drainage.

3. The compliant upright drink insulator attachment device according to claim 1 wherein there are at least two of said extensions.

4. The compliant upright drink insulator attachment device according to claim 3 wherein there are four of said extensions.

5. The compliant upright drink insulator attachment device according to claim 4 wherein said extensions are flexible.

6. The compliant upright drink insulator attachment device according to claim 1 wherein said second member allows fluids to flow through said second member.

7. The compliant upright drink insulator attachment device according to claim 1 wherein said second member further includes a hook boss or land that extends between said tabs.

8. The compliant upright drink insulator attachment device according to claim 1 wherein said tether is coiled.

9. The compliant upright drink insulator attachment device according to claim 1 wherein said tether is flexible.

10. The compliant upright drink insulator attachment device according to claim 1 wherein said weight is between 2 and 8 ounces.

11. The compliant upright drink insulator attachment device according to claim 10 wherein said weight is between 5.0 and 5.5 ounces.

12. The compliant upright drink insulator attachment device according to claim 1 wherein said weight further includes indicia.

13. The compliant upright drink insulator attachment device according to claim 12 wherein said indicia is a company logo, slogan, sport logo, football helmet, baseball, soccer ball, basketball zodiac sign, hobby or animal.

14. The compliant upright drink insulator attachment device according to claim 1 wherein said weight is configured to fit completely within said beverage insulator.

15. The compliant upright drink insulator attachment device according to claim 1 wherein said first member is made from a material selected from a group consisting of steel, stainless steel, rubber, plastic, carbon fiber, acrylic, wood or fiberglass.

16. The compliant upright drink insulator attachment device according to claim 1 wherein said second member is made from a material selected from a group consisting of steel, stainless steel, rubber, plastic, carbon fiber, acrylic, wood or fiberglass.

17. The compliant upright drink insulator attachment device according to claim 1 wherein said first end of said tether further includes a clipping device.

18. The compliant upright drink insulator attachment device according to claim 17 wherein said clipping device clips through said crown in said first member.

19. The compliant upright drink insulator attachment device according to claim 18 wherein said clipping device further includes a swivel.

20. The compliant upright drink insulator attachment device according to claim 1 wherein said attachment device is removable from said beverage insulator.

* * * * *